US007349798B2

(12) United States Patent
Beyene

(10) Patent No.: US 7,349,798 B2
(45) Date of Patent: Mar. 25, 2008

(54) REMOTE CONTROL OF ENGINE OPERATION IN A MOTOR VEHICLE

(75) Inventor: Michael M. Beyene, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 10 days.

(21) Appl. No.: 11/376,077

(22) Filed: Mar. 15, 2006

(65) Prior Publication Data

US 2006/0244626 A1 Nov. 2, 2006

Related U.S. Application Data

(60) Provisional application No. 60/662,242, filed on Mar. 15, 2005.

(51) Int. Cl.
*G06G 7/70* (2006.01)
*G08B 5/22* (2006.01)

(52) U.S. Cl. ..... 701/115; 123/179.2; 340/825.37

(58) Field of Classification Search ..... 701/102, 701/110, 113, 115; 123/179.2; 340/825.37
See application file for complete search history.

(56) References Cited

U.S. PATENT DOCUMENTS

| | | | | |
|---|---|---|---|---|
| 3,078,834 | A | 2/1963 | Wright | |
| 3,163,770 | A | 12/1964 | Smedley | |
| 3,282,259 | A | 11/1966 | Moor | |
| 3,357,417 | A | 12/1967 | Baumann | |
| 3,507,259 | A | 4/1970 | Lankford | |
| 3,543,302 | A | 11/1970 | Wolthausen | |
| 4,006,723 | A | 2/1977 | Schmidli | |
| 4,080,537 | A | 3/1978 | Bucher | |
| 4,236,594 | A | 12/1980 | Ramsperger | |
| 4,291,653 | A | 9/1981 | Tucker | |
| 5,042,439 | A | 8/1991 | Tholl et al. | |
| 5,054,569 | A | 10/1991 | Scott et al. | |
| 5,602,450 | A | 2/1997 | Cowan et al. | |
| 5,617,819 | A | 4/1997 | Dery et al. | |
| 5,794,580 | A | 8/1998 | Galletti | |
| 5,990,800 | A | 11/1999 | Tamaki et al. | |
| 6,396,388 | B1 | 5/2002 | Dong | |
| 6,467,448 | B2 | 10/2002 | Wisnia et al. | |
| 6,522,029 | B1 | 2/2003 | Bell et al. | |
| 6,789,519 | B1 | 9/2004 | Bell | |
| 6,860,248 | B1 | 3/2005 | Mene | |
| 2006/0095197 | A1 * | 5/2006 | Nishi et al. | 701/113 |

* cited by examiner

*Primary Examiner*—Willis R. Wolfe
*Assistant Examiner*—Johnny H. Hoang
(74) *Attorney, Agent, or Firm*—Jeffrey P. Calfa; Gerald W. Askew

(57) ABSTRACT

A set of remote switches (14, 16) located outside the cab of a truck enables service personnel to crank, accelerate, decelerate, and shut off the truck's engine without having to enter the cab. The set of switches are interlocked with controls (12, 13) inside the occupant compartment, including the ignition switch (12) that is used to crank the engine from inside the cab, via an engine control system (11) that uses the state of a switch that senses locking/unlocking of the cab on the chassis engine control system (11) to select either the remote switches or the occupant compartment controls to the exclusion of the other for controlling engine running once the engine has been cranked and started.

18 Claims, 12 Drawing Sheets

| Variables | | | | | |
|---|---|---|---|---|---|
| Change | Name | Description/Units | Working Range | Resolution | Initial Value |
| Input Variables | | | | | |
| New | CAN_NEUTRAL_SW | PGN 65291 Byte 1 Bits 5-6 Neutral Switch State (1=neutral) | 0:1 | 1 | 0 |
| New | CAN_REMOTE_START_EN | PGN 65291 Byte 1 Bits 1-2 Remote Switch State (1=enable) | 0:1 | 1 | 0 |
| New | IC_START_SW_STS | In-cab Crank Switch Input Status | 0:1 | 1 | 0 |
| New | DDS_CRANK_STS | Driveline Disengage Signal | 0:1 | 1 | 0 |
| New | RUN_LTCH_FLG | Run Latch Flag Status (1=set) | 0:1 | 1 | 0 |
| New | NLIDLE | Low Idle Engine Speed | 0:3500 | 0.25 | 0 |
| New | PBA_CRANK_EN | Parking Brake Status for Cranking | 0:1 | 1 | 0 |
| New | R_START_SW_STS | Remote Start Switch Input Status | 0:1 | 1 | 0 |
| New | R_STOP_SW_STS | Remote Stop Switch Input Status | 0:1 | 1 | 0 |
| New | VS | Vehicle Speed (mph) | 0:127.5 | 0.0625 | 0 |
| New | VSS_F_ORH | Vehicle Speed Input Fault | 0:1 | 1 | 0 |
| New | RESET_TIMER | Reset Timer value | 0:6553.5 | .1 | 0 |
| Local Variables | | | | | |
| New | CAN_NEUTRAL_SW_EN | Neutral Switch Status For Remote Cranking (1=enable) | 0:1 | 1 | 0 |
| New | R_SWITCH_F | Remote Switch Inputs Fault Detected | 0:1 | 1 | 0 |
| New | R_SWITCH_F_CNTR | Remote Switch Fault Counter | 0:65535 | 1 | 0 |
| New | IC_SWITCH_F_CNTR | In-cab Switch Fault Counter | 0:65535 | 1 | 0 |
| New | IC_CRANK_EN | In-cab Cranking Enabled | 0:1 | 1 | 0 |
| New | R_TIMER_EN | Time Based Enable for Cranking on Key On | 0:1 | 1 | 0 |
| New | R_CRANK_EN | Remote Cranking Enabled | 0:1 | 1 | 0 |
| New | CCCS_VSS_EN | Vehicle Speed Based Enabled | 0:1 | 1 | 0 |
| Output Variables | | | | | |
| New | R_START_SW_F_FLG | Remote Start Switch Input Fault Flag | 0:1 | 1 | 0 |
| New | R_STOP_SW_F_FLG | Remote Stop Switch Input Fault Flag | 0:1 | 1 | 0 |
| New | R_SWITCH_F_FLG | Remote Switch Input Fault Flag | 0:1 | 1 | KAM |
| New | IC_SWITCH_F_FLG | In-cab Crank Input Switch Fault Flag | 0:1 | 1 | KAM |
| New | R_START_N_DES | Remote Start Desired Engine Speed (rpm) | 0:3500 | 0.25 | 0 |
| New | R_STOP_FLG | Remote Stop Fuel Flag | 0:1 | 1 | 0 |
| New | CRANK_ENABLE | In-cab/Remote Cranking Enable (1=enable) | 0:1 | 1 | 0 |

| Programmable Parameters | | | | | |
|---|---|---|---|---|---|
| Change | Name | Description/Units | Working Range | Resolution | Initial Value |
| New | NGV(PP) | Vehicle Type (5=1335 VW Application) | 0:5 | 1 | 5 |

| Calibration Scalars | | | | | |
|---|---|---|---|---|---|
| Change | Name | Description/Units | Working Range | Resolution | Initial Value |
| New | R_SWITCH_F_INC | Remote Switch Fault Increment | 0:65535 | 1 | 0 |
| New | R_SWITCH_F_DEC | Remote Switch Fault Decrement | 0:65535 | 1 | 0 |
| New | IC_SWITCH_F_INC | In-cab Switch Fault Increment | 0:65535 | 1 | 0 |
| New | IC_SWITCH_F_DEC | In-cab Switch Fault Decrement | 0:65535 | 1 | 0 |
| New | R_START_N_INC | Remote Start Engine Speed Increment Value (rpm) | 0:3500 | 0.25 | 100 |
| New | R_START_N_MAX | Remote Start Max Allowed Engine Speed (rpm) | 0:3500 | 0.25 | 2000 |
| New | R_START_DEB_TM | Remote Start Debounce time (msec) | 0:12750 | 50 | 200 |
| New | R_STOP_DEB_TM | Remote Stop Debounce time (msec) | 0:12750 | 50 | 200 |
| New | IC_START_DEB_TM | In-cab Start Debounce Time (msec) | 0:12750 | 50 | 200 |
| New | R_ENABLE_TM | Key on Time to enable Diagnostics (sec) | 0:25.5 | 0.1 | 2 |

FIG. 4

| Variables | | | | |
|---|---|---|---|---|
| Name | Description/Units | Working Range | Resolution | Initial Value |
| Input Variables | | | | |
| CAN_NEUTRAL_SW | PGN 65291 Byte 5 Bits 5-6 Neutral Switch State (1=Neutral) | 0:1 | 1 | 0 |
| CAN_CAB_LOCKED | PGN 65291 Byte 5 Bits 7-8 Cabin Locked (1=Locked) | 0:1 | 1 | 0 |
| IC_START_SW_STS | In-Cab Crank Switch Input Status | 0:1 | 1 | 0 |
| DDS_CRANK_STS | Driveline Disengage Signal | 0:1 | 1 | 0 |
| RUN_LTCH_FLG | Run Latch Flay Status (1=Set) | 0:1 | 1 | 0 |
| NLIDLE | Low Idle Engine Speed | 0:3500 | 0.25 | 0 |
| N | Engine Speed | 0:4000 | 0.25 | 0 |
| PBA_CRANK_EN | Tamper Proofed Parking Brake Status For Cranking | 0:1 | 1 | 0 |
| PBA_STA | Parking Brake Status | 0:1 | 1 | 0 |
| R_START_SW_STS | Remote Start Switch Input Status | 0:1 | 1 | 0 |
| R_STOP_SW_STS | Remote Stop Switch Input Status | 0:1 | 1 | 0 |
| VS | Vehicle Speed (Mph) | 0:127.5 | 0.0625 | 0 |
| VSS_F_ORH | Vehicle Speed Input Fault | 0:1 | 1 | 0 |
| RESET_TMR | Reset Timer Value | 0:6553.5 | 1 | 0 |
| DDS_TP_FLG | Indicates That DDS Signal Is Tamper Proofed | 0:1 | 1 | 0 |
| LOCAL VARIABLES | | | | |
| CAN_NEUTRAL_SW_EN | Neutral Switch Status For Remote Cranking (1=Enable) | 0:1 | 1 | 0 |
| R_SWITCH_F | Remote Switch Inputs Fault Detected | 0:1 | 1 | 0 |
| R_SWITCH_F_CNTR | Remote Switch Fault Counter | 0:65535 | 1 | 0 |
| IC_SWITCH_F_CNTR | In-Cab Switch Fault Counter | 0:65535 | 1 | 0 |
| IC_CRANK_EN | In-Cab Cranking Enabled | 0:1 | 1 | 0 |
| R_TIMER_EN | Time Based Enable For Cranking On Key On | 0:1 | 1 | 0 |
| R_CRANK_EN | Remote Cranking Enable | 0:1 | 1 | 0 |
| CCCS_VSS_EN | Vehicle Speed Based Enable | 0:1 | 1 | 0 |
| CCCS_PBA_STS | PBA Status Used | 0:1 | 1 | 0 |
| CCCS_GEAR_STS | Gear Status Used | 0:1 | 1 | 0 |
| R_TEST_STS | Remote Test Status | 0:1 | 1 | 0 |
| R_TEST_DUR_TMR | Remote Test Duration Timer (Sec) | 0:255 | 1 | 0 |
| R_SS_SW_TMR | Remote Start/Stop Switch Timer, Both Switches Pressed (Sec) | 0:255 | 1 | 0 |
| R_START_LTCH | Remote Start Latch (Remote Start Requested) | 0:1 | 1 | 0 |
| R_SS_SW_TRNS | Remote Start/Stop Switch Transition | 0:1 | 1 | 0 |
| R_TEST_TMR | Remote Test Timer (Sec) | 0:255 | 1 | 0 |
| R_N_CHG_SUM | Remote Engine Speed Change Type (3:Accel,5 Decel) | 0:255 | 1 | 0 |
| R_N_CHG_STS | Remote Engine Speed Change Request | 0:1 | 1 | 0 |
| R_N_INC | Remote Engine Speed Increment Value (Rpm) | 0:4000 | 0.25 | 0 |
| R_N_INC_TMR | Remote Engine Speed Increment Timer (Sec) | 0:255 | 1 | 0 |
| R_N_DEC | Remote Engine Speed Decrement Value (Rpm) | 0:4000 | 0.25 | 0 |
| R_N_DEC_TMR | Remote Engine Speed Decrement Timer (Sec) | 0:255 | 1 | 0 |
| R_N_DES | Remote Engine Speed Desired (Rpm) | 0:4000 | 0.25 | 0 |
| R_OFF_IDLE_TMR | Remote Off Idle Timer (Sec) | 0:1800 | 1 | 0 |
| R_OFF_IDLE_STS | Remote Off Idle Status | 0:1 | 1 | 0 |
| R_START_OK | Remote Start Allowed Based On Remote Stop Conditions | 0:1 | 1 | 0 |
| R_STOP_STS | Latched Value Of Remote Stop Request Status | 0:1 | 1 | 0 |
| R_START_SW_TRNS | Remote Start Switch Transition Detected (1:Detected) | 0:1 | 1 | 0 |
| R_STOP_SW_TRNS | Remote Stop Switch Transition Detected (1:Detected) | 0:1 | 1 | 0 |
| R_STOP_VS_STS | Value Of Remote Stop VS Based Status | 0:1 | 1 | 0 |
| R_STOP_PBA_STS | Value Of Remote Stop PBA Based Status | 0:1 | 1 | 0 |
| OUTPUT VARIABLES | | | | |
| R_START_SW_F_FLG | Remote Start Switch Input Fault Flag | 0:1 | 1 | 0 |
| R_STOP_SW_F_FLG | Remote Stop Switch Input Fault Flag | 0:1 | 1 | 0 |
| R_SWITCH_F_FLG | Remote Switch Input Fault Flag | 0:1 | 1 | Kam |
| IC_SWITCH_F_FLG | In-Cab Crank Input Switch Fault Flag | 0:1 | 1 | Kam |
| R_START_N_DES | Remote Start Desired Engine Speed (Rpm) | 0:3500 | 0.25 | 0 |
| R_STOP_FLG | Remote Stop Fuel Flag | 0:1 | 1 | 0 |
| CRANK_ENABLE | In-Cab/Remote Cranking Enable (1=Enable) | 0:1 | 1 | 0 |

FIG. 11

| Programmable Parameters | | | | |
|---|---|---|---|---|
| Name | Description/Units | Working Range | Resolution | Initial Value |
| NVG (PP) | Vehicle Type (5=1335 VW Application) | 0:5 | 1 | 5 |

| Programmable Parameters | | | | |
|---|---|---|---|---|
| Name | Description/Units | Working Range | Resolution | Initial Value |
| R_SWITCH-F-INC | Remote Switch Fault Increment | 0:65535 | 1 | 0 |
| R_SWITCH_F_DEC | Remote Switch Fault Decrement | 0:65535 | 1 | 0 |
| IC_SWITCH_F_INC | In-Cab Switch Fault Increment | 0:65535 | 1 | 0 |
| IC_SWITCH _F_INC | In-Cab Switch Fault Decrement | 0:65535 | 1 | 0 |
| R_START_N_INC | Remote Start Engine Speed Increment Value (Rpm) | 0:3500 | .025 | 100 |
| R_START_N_MAX | Remote Start Max Allowed Engine Speed (Rpm) | 0:3500 | 0.25 | 2000 |
| R_START_DEB_TM | Remote Start Debounce Time (Msec) | 0:12750 | 50 | 200 |
| R_STOP_DEB_TM | Remote Stop Debounce Time (Msec) | 0:12750 | 20 | 200 |
| IC_START_DEB_TM | In-Cab Start Debounce Time (Msec) | 0:12750 | 50 | 200 |
| R_ENABLE_TM | Key On Time To Enable Diagnostics (Sec) | 0:25.5 | 0.1 | 2 |
| IC_LOG_SEL | VW In-Cab Logic Selection Switch | 0:3 | 1 | 0 |
| R_TEST_N_MIN | Min Engine Speed To Enable Remote Test Timer (Rpm) | 0:4000 | 0.25 | 100 |
| R_TEST_DUR_TM | Remote Test Duration Time (Sec) | 0:255 | 1 | 15 |
| R_CRANK_TM | Time Delay To Allow Remote Start (Sec) | 0:255 | 1 | 0 |
| R_TEST_TM | Delay Between Remote Stop And Start Switch To Enable Remote Test (Sec) | 0:255 | 1 | 3 |
| R_STOP_TM | Time Delay To Allow Remote Stop (Sec) | 0:255 | 1 | 2 |
| R_START_N_INC | Remote Start Speed Increment Value (Rpm) | 0:4000 | 0.25 | 100 |
| R_START_N_INC2 | Remote Start Sped Increment Value (Rpm) | 0:4000 | 0.25 | 250 |
| R_N_INC_TM | Remote Start Min Time To Select Increment Value 2 (Sec) | 0:255 | 1 | 5 |
| R_START_N_DEC | Remote Start Speed Decrement Value (Rpm) | 0:4000 | 0.25 | 100 |
| R_START_N_DEC2 | Remote Start Speed Decrement Value 2(Rpm) | 0:4000 | 0.25 | 250 |
| R_N_DEC_TM | Remote Start Min Time To Select Decrement Value 2 (Sec) | 0:255 | 1 | 5 |
| R_OFF_IDLE_THLD | Remote Start Off Idle Hystersis (Rpm) | 0:4000 | 0.25 | 50 |
| R_OFF_IDLE_TM | Remote Start Max Off Idle Time (Sec) | 0:1800 | 1 | 120 |
| R_TP_SEL | Tamper Proofed Signals Selection Switch (1: Tamper Proof Selected) | 0:2 | 1 | 0 |

FIG. 12

REMOTE CONTROL OF ENGINE OPERATION IN A MOTOR VEHICLE

REFERENCE TO A RELATED APPLICATION AND PRIORITY CLAIM

This application claims the priority of Provisional Application No. U.S. 60/662,242, filed 15 Mar. 2005, in the name of the same inventor.

FIELD OF THE INVENTION

This invention relates to remote control of engine operation in a motor vehicle, a large highway truck for example.

BACKGROUND OF THE INVENTION

A typical large truck has a cab where a driver sits to operate the truck. When the driver wishes to start the engine, he operates an ignition switch, typically by inserting a key into a barrel of the switch and turning it clockwise from OFF position to CRANK position against an opposing force of an internal return spring. In the process, the switch passes through IGNITION position.

In CRANK position, the ignition switch energizes IGNITION and CRANK circuits in the truck's electrical system causing various engine systems to begin operating so that the engine is fueled and the starter motor cranked. Once the engine has begun to run under its own power, the driver can release the key to allow the internal return spring to return the switch from CRANK position to IGNITION position. IGNITION position may sometimes be referred to as ON position. The driver can then accelerate the engine by depressing an accelerator pedal.

When the driver desires to turn off the engine, he turns the ignition switch counterclockwise from ON position to OFF position. Turning the key farther counterclockwise beyond OFF position places the switch in ACCESSORY position, a position that energizes certain ACCESSORY circuits in the truck without the engine running. Those ACCESSORY circuits are also typically energized when the ignition switch is in IGNITION position, but not when the switch is in either OFF position or CRANK position.

When a truck is being serviced, it may be desirable to perform certain procedures that involve running the engine. Those procedures may require that the engine be cranked, and then accelerated and decelerated in various ways after the engine has begun running under its own power, and ultimately turned off. When those procedures are performed while the truck is parked, the transmission should obviously not be in a forward or reverse drive gear.

Some procedures may be more conveniently performed by service personnel from a location other than inside the cab. Depending on the particular type of the particular truck, it may not even be possible for personnel to enter and exit the cab during some procedures. For example, a cab-over truck may require that the cab be unlatched from the chassis and then swung upwardly on the chassis in order to obtain access to the engine which underlies the cab when the cab is latched to the chassis for normal driving.

Accordingly, an ability to operate the engine from a location outside the cab is desirable for servicing some motor vehicles, such as certain large trucks like cab-overs. Service personnel need to be able to mimic functions of the ignition switch and accelerator pedal from a remote location to crank, accelerate, decelerate, and stop the engine.

Having a duplicate ignition switch and accelerator control outside the cab however raises potential safety issues. Any remote control system for starting, operating, and stopping an engine in a motor vehicle must address those issues in an acceptable way while providing service personnel with the capabilities needed to service the vehicle.

SUMMARY OF THE INVENTION

The present invention relates to a remote control system that addresses such issues while enabling service personnel to crank, accelerate, decelerate, and shut off a motor vehicle engine without having to enter a passenger compartment, such as the cab of a large truck, and operate the ignition switch and accelerator pedal that are inside the passenger compartment.

One generic aspect of the present invention relates to a method for remote control of an engine in a motor vehicle as described herein, an example of which is remote control of a compression ignition engine that forms the powerplant of a large truck.

Another generic aspect relates to the remote control system and its integration with a pre-existing engine control system, as described herein.

The invention also concerns a control input selection system for controlling an engine in a motor vehicle through the selective use of two sets of control inputs to an engine control system. One set comprises occupant compartment controls inside an occupant compartment and the other set comprises remote controls outside the occupant compartment.

The selection system comprises a selection input to the engine control system for selecting one of the two sets, and a processor in the engine control system for processing the selection from the selection input and enabling the engine control system, once the engine has been started and is running, to control certain functions related to running of the engine from the set selected by the selection input to the exclusion of the other set.

The invention further concerns a method for enabling a running engine in a motor vehicle to be operated by controls that are remote from occupant compartment controls that include an ignition switch. The method comprises selecting one of the two controls via a selection input to a processor of an engine control system and processing the selection from the selection input to select one of the controls to control continued running of the engine to the exclusion of the other.

The foregoing, along with further features and advantages of the invention, will be seen in the following disclosure of a presently preferred embodiment of the invention depicting the best mode contemplated at this time for carrying out the invention. This specification includes drawings, now briefly described as follows.

BRIEF DESCRIPTION OF THE DRAWINGS

FIG. 4 is a table containing more detail about variables, programmable parameters, and calibration scalars shown in the preceding Figures.

FIG. 11 is a table containing more detail about variables related to the strategy of FIGS. 5-10.

FIG. 12 is a table containing more detail about programmable parameters and calibration scalars related to the strategy of FIGS. 5-10.

DESCRIPTION OF THE PREFERRED EMBODIMENT

Figure 1:
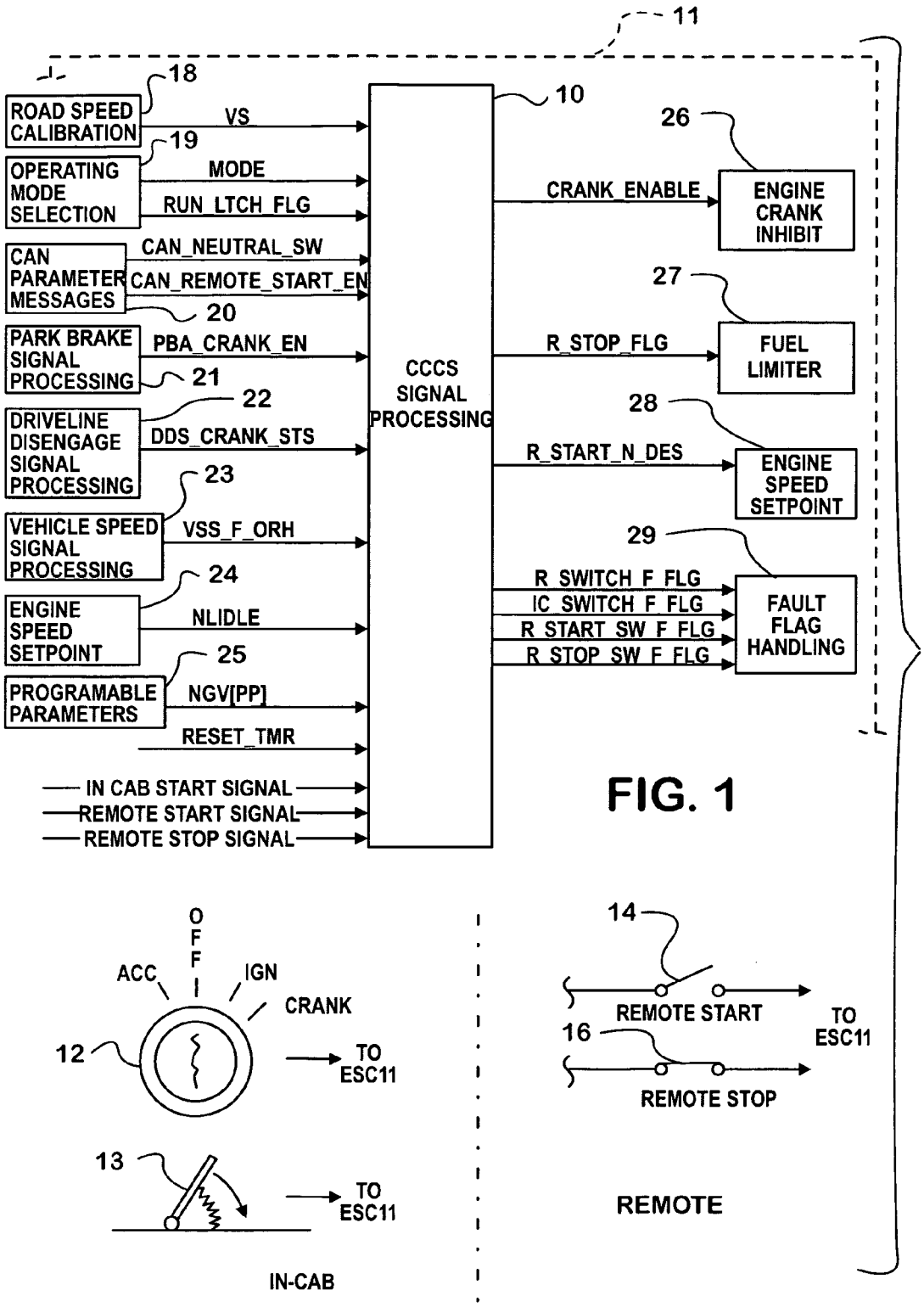
FIG. 1 is an interface diagram that shows a virtual controller (CCCS Signal Processing) interfacing certain controlling inputs with certain controlled outputs in accordance with principles of the present invention in a truck. Both in-cab and remote devices provide certain of the controlling inputs to the virtual controller.

FIG. 1 shows an interface 10 that is embodied in an electronic system controller, or ESC, 11 of a truck's electrical system. The interface may also sometimes be referred to as a virtual controller that is created by programming one or more processors of the ESC with an algorithm corresponding to the strategy shown in FIGS. 2 and 3. When the virtual controller processes certain input data shown in FIG. 1, it develops certain output data, also shown in FIG. 1, for controlling certain functions.

The input data comprises the following variables also identified in FIG. 4: VS representing vehicle speed; MODE; RUN_LTCH_FLG indicating that the engine has been running for a period of time (about five seconds for example) after having been cranked; CAN_NEUTRAL_SW representing the state of a neutral start switch in the truck; CAN_REMOTE_START_EN that distinguishes between enablement and non-enablement of a remote start function; PBA_CRANK_EN for enabling cranking based on certain criteria involving a park brake switch in the truck; DDS_CRANK_STS that distinguishes between engagement and disengagement of the truck's driveline; VSS_F_ORH that indicates a vehicle speed input fault; NLIDLE that represents low idle engine speed; NGV[PP] that identifies the particular truck model; RESET_TMR that represents an amount of time that has elapsed since "key-on" was detected, up to a defined amount of time; In-cab_Start_Signal that indicates when an ignition switch 12 has been placed in CRANK position; Remote_Start_Signal that indicates when a remote start switch 14 has been placed in On position to crank the engine from outside the cab; and Remote_Stop_Signal that indicates when a remote stop switch 16 has been placed in On position to stop the engine from outside the cab. Notice that remote start switch 14 is normally open, meaning that turning the switch on, closes it, and that remote stop switch 16 is normally closed, meaning that turning it on, opens it.

The output data comprises: CRANK_ENABLE that distinguishes between enablement and non-enablement of engine cranking; R_STOP_FLG that indicates the state of a remote stop flag: R_START_N_DES that represents remote start desired engine speed; R_SWITCH_F_FLG that represents the status of a remote start input fault flag; IC_SWITCH_F_FLG that represents the status of an in-cab crank input fault flag; R_START_SW_F_FLG that represents the status of a remote start switch input fault flag; and R_STOP_SW_F_FLG that is used to stop the engine by stopping engine fueling.

The sources of input data include: Road Speed Calibration 18; Operating Mode Selection 19; CAN Parameter Messages 20; Park Brake Signal Processing 21; Driveline Disengage Signal Processing 22; Vehicle Speed Signal Processing 23; and Engine Speed Setpoint 24. Those sources pre-exist in ESC 11.

One additional source is Programmable Parameters 25. That is a feature of ESC 11 that is used to install the remote start feature in selected truck models.

Other sources are ignition switch 12 that is disposed in or near an instrument cluster or dash inside the truck cab and that functions to turn the truck's engine on and off. A key is typically required to operate ignition switch 12 for selectively placing the switch in ACCESSORY (ACC), OFF, IGNITION (IGN), and CRANK positions. The key is typically inserted into the switch barrel when the switch is in OFF position. Turning the inserted key counterclockwise from OFF position places the switch in ACCESSORY position. Turning the inserted key clockwise from OFF position places the switch first in IGNITION, or ON, position. Turning the key still farther clockwise against an internal return spring places the switch in CRANK position for cranking the engine at starting. Typically the key can be physically removed from the switch only in OFF position.

Ignition switch 12 interfaces with virtual controller 10 through ESC 11.

ESC processing functions that utilize the output data of virtual controller 10 for control of certain engine functions are: an Engine Crank Inhibit function 26; a Fuel Limiter function 27; an Engine Speed Setpoint function 28; and a Fault Flag Handling function 29. Those functions are pre-existing in ESC 11.

The algorithms programmed in the one or more processors of ESC 11 are repeatedly executed when ESC 11 is operating. ESC 11 is powered up by turning ignition switch 12 to a position other than OFF. Hence, use of the remote start feature requires that personnel enter the cab and turn the ignition switch to IGNITION position, sometimes referred to as "key-on" position, or simply "ON" position.

Figure 2:
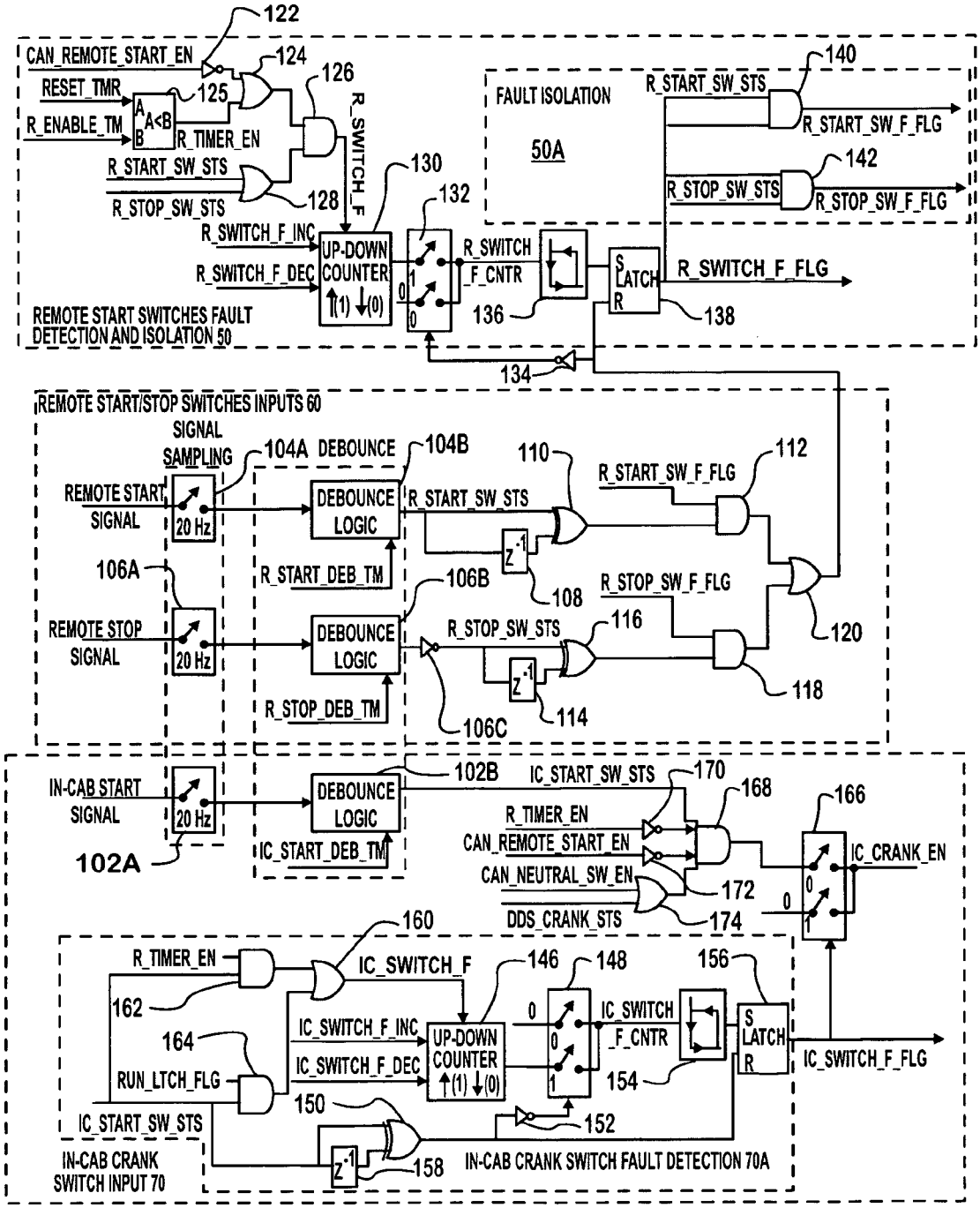
FIG. 2 is a portion of the software strategy logic creating the virtual controller of FIG. 1.
Figure 3:
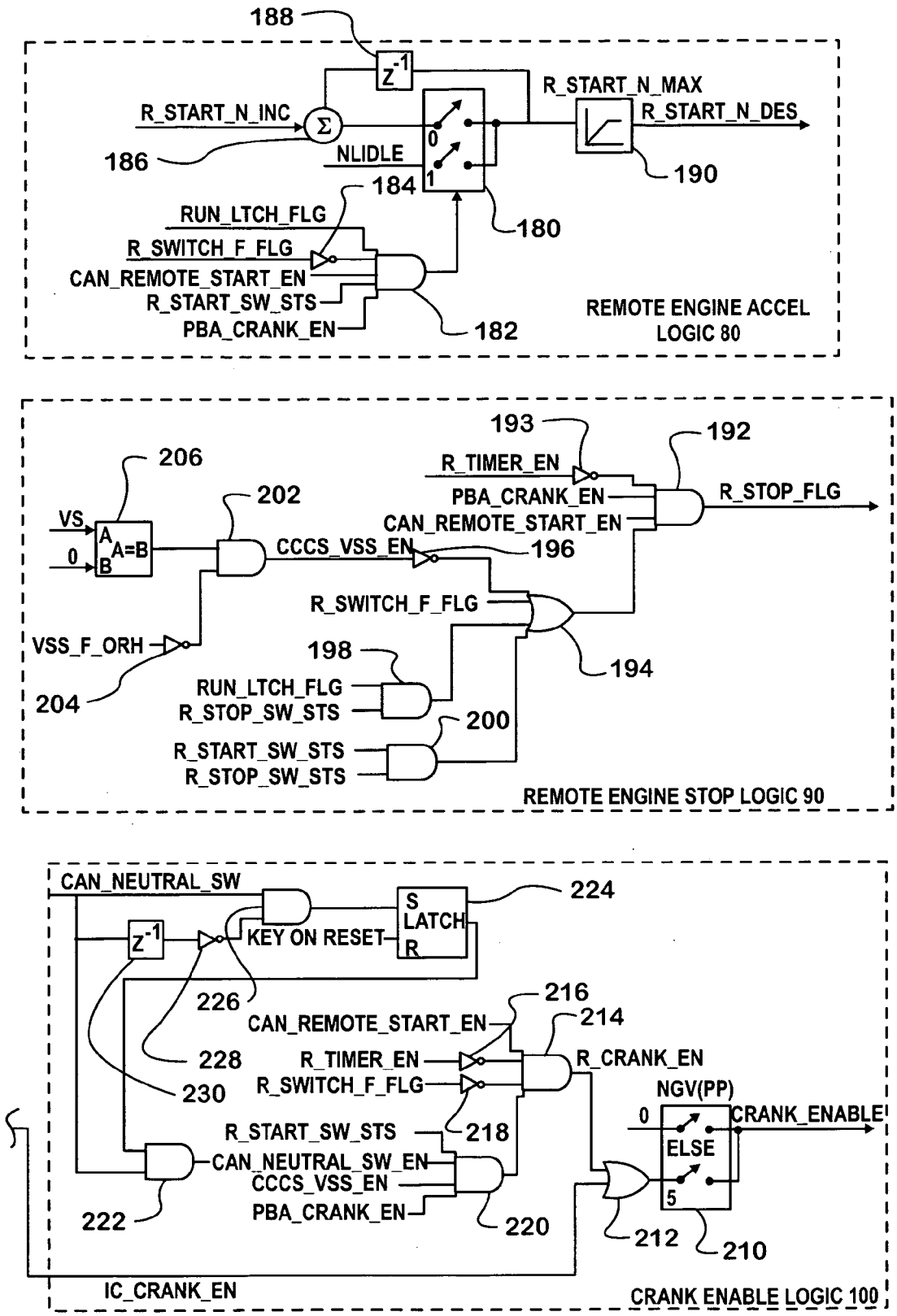
FIG. 3 is another portion of the software strategy logic.

The strategy shown in FIGS. 2 and 3 is organized into several processing sections as shown in those Figures to comprise: Remote Start Switches Fault Detection and Isolation section 50; Remote Start/Stop Switches Inputs section 60; In-cab Crank Switch Input section 70; Remote Engine Accel. (Acceleration) Logic section 80; Remote Engine Stop Logic section 90; and Crank Enable Logic section 100. Section 50 includes a Fault Isolation sub-section 50A, and section 70, an In-cab Crank Switch Fault Detection sub-section 70A.

A signal for starting the truck's engine can originate at either ignition switch 12 or remote start switch 14. Upon detecting operation of ignition switch 12 to CRANK position, ESC 11 causes the In-Cab Start Signal to be given. As a result, the engine will be cranked. Operation of remote start switch 14 to ON position acts on ESC 11 to cause ESC 11 to issue the Remote Start Signal to section 60. As a result, the engine will be cranked provided that ignition switch 12 and remote stop switch 16 satisfy certain conditions.

An important aspect of the present invention concerns the definition of those various conditions and how they are related to control of starting, running, and stopping the engine so as to allow only the in-cab ignition switch 12 and accelerator pedal 13, or only the remote switches 14 and 16, to start, run, and stop the engine. In other words, by enabling the remote starting feature, only remote switches 14 and 16 are enabled to start, run, and stop the engine, and when remote starting is not enabled, switches 14 and 16 cannot start, run, and stop the engine. Likewise, enabling the remote starting feature renders ignition switch 12 ineffective to start the engine. Unenabling the remote starting feature restores the ability of the ignition switch to start and stop the engine. Moreover, upon ESC 11 being powered up, the invention provides diagnostic fault detection for indicating certain fault conditions and preventing engine starting when faults are diagnosed. Diagnostic fault detection also remains active continuously while ignition switch 12 has control over engine starting and stopping.

The Remote Start Signal is an input to Remote Start/Stop Switches Inputs section 60. The In-Cab Start Signal is an input to In-cab Crank Switch Input section 70. The Remote Stop Signal is a second input to Remote Start/Stop Switches Input section 60, and is given by placing remote stop switch 16 in ON position. FIG. 1 shows both switches 14 and 16 in their OFF positions, i.e. switch 14 open, switch 16 closed.

Because the ignition switch, remote start switch, and remote stop switch are mechanical switches that may exhibit switch contact bounce when actuated, algorithms of sections 60 and 70 take the possibility of such bounce into account.

Each signal, In-Cab Start Signal, Remote Start Signal, and Remote Stop Signal, is frequently sampled, such as at a 20 Hz. sample rate, by a respective sampling function 102A, 104A, 106A. Each sampled Signal is then processed by a respective Debounce Logic function 102B, 104B, 106B that utilizes a respective Calibration Scalar IC_START_DEB_TM, R_START_DEB_TM, and R_STOP_DEB_TM that establishes a respective debounce time that is sufficiently long to assure that the respective switch has settled in the position indicated by the respective Signal.

The output of Debounce Logic function 104B is a data value for the variable R_START_SW_STS. When Remote Start Switch 14 is ON, that data value is "1", and when Switch 14 is OFF, the data value is "0".

The output of Debounce Logic function 106B is a data value that is the inverse of a data value for the variable R_STOP_SW_STS. The inversion is the result of processing the output of function 106B by an inverting function 106C. Consequently, when Remote Stop Switch 16 is OFF, the data value for R_STOP_SW_STS is "1", and when Switch 16 is ON, the data value is "0".

The output of Debounce Logic function 102B is a data value for the variable IC_START_SW_STS. When the In-Cab Start Signal indicates that ignition switch 12 is in CRANK position, the data value for IC_START_SW_STS is "1", and when the Signal indicates that the switch is not in CRANK position, the data value is "0".

Section 60 processes the data values for R_START_SW_STS and R_STOP_SW_STS to develop a data value that is processed by Section 50 for use in detecting a fault in either remote start switch 14 or remote stop switch 16 and identifying which switch or switches show a detected fault. A store function 108 and an exclusive OR function 110 process the data value for R_START_SW_STS to develop a data value for one input to an AND logic function 112. A store function 114 and an exclusive OR function 116 process the data value for R_STOP_SW_STS to develop a data value for one input to an AND logic function 118. Each AND logic function 112, 118 processes the respective inputs to it to develop a data value for a respective output that serves as a respective input to an OR logic function 120. OR logic function 120 processes the inputs to it to develop the data value that section 60 provides to section 50. A store function is a function that stores the value that was present at its input at the time of a previous iteration of the algorithm to enable that value to be used in processing that occurs during a succeeding iteration.

The arrangement provided by each exclusive OR function 110, 116 and the associated store function 108, 114 functions to detect a change in the state of the respective switch 14, 16. Hence, when R_START_SW_STS indicates that remote start switch 14 has been switched either to ON from OFF or vice versa, the output of exclusive OR function 110 will become a "1" for one iteration of the algorithm. Likewise when R_START_SW_STS indicates that remote start switch 14 has been switched to OFF from ON or vice versa, the output of exclusive OR function 110 will become a "1" for one iteration of the algorithm.

In the same way, when R_STOP_SW_STS indicates that remote stop switch 16 has been switched to ON from OFF or vice versa, the output of exclusive OR function 116 will become a "1" for one iteration of the algorithm. Likewise when R_STOP_SW_STS indicates that remote stop switch 16 has been switched to OFF from ON or vice versa, the output of exclusive OR function 116 will become a "1" for one iteration of the algorithm.

In addition to processing the data value for the output of exclusive OR function 110, AND logic function 112 processes the data value for R_START_SW_F_FLG. In addition to processing the data value for the output of exclusive OR function 116, AND logic function 118 processes the data value for R_STOP_SW_F_FLG. When the remote start switch fault flag indicates a remote start switch fault, a change in state of the remote start switch will cause the output of AND logic function 112 to become a "1" for one iteration of the algorithm; however, if the remote start switch fault flag is not indicating a remote start switch fault, then a change in state of the remote start switch will not cause the output of AND logic function to change from a "0" to a "1". OR logic function 120 serves to pass a "1" from either AND logic function 112 or from AND logic function 118 to Section 50.

The remote start function is enabled by a CAN parameter message resulting in a data value for CAN_REMOTE_START_EN that enables remote starting. CAN_REMOTE_START_EN is a result of some input to the ESC such as unlatching the cab from the chassis in the case of a cab-over type truck. CAN_REMOTE_START_EN is an input to an inverting function 122 whose output is one input to an OR logic function 124. The other input to OR logic function 124 is from the output of a comparison function 125. There are two inputs to comparison function 125. One is RESET_TMR and the other is R_ENABLE_TM.

The data value for R_ENABLE_TM represents a short time window (about two seconds for example) commencing with key-on and during which the status of switches 14 and 16 is checked. The data value for parameter RESET_TMR represents the elapsed time during the time window. Before the window of time has elapsed, the data value for R_TIMER_EN is a "1". Upon elapse, that data value changes to a "0". Consequently, the data value that OR logic function 124 provides to an AND logic function 126 before the window of time has elapsed is a "1" and upon elapse, a "0".

The other input to AND logic function 126 is from an OR logic function 128. R_START_SW_STS and R_STOP_SW_STS are the two inputs to OR logic function 128. If the data value for either R_START_SW_STS or R_STOP_SW_STS is a "1" at any time before the window of time elapses, that causes the output of AND logic function 126, representing R_SWITCH_F, to become a "1".

The data value for R_SWITCH_F controls the direction of counting of an Up-Down Counter 130 that can count up in up-count increments and down in down-count decrements. The data value for the parameter R_SWITCH_F_INC defines the up-count increment and the data value for the parameter R_SWITCH_F_DEC defines the down-count decrement. When R_SWITCH_F has a data value of "1", Counter 130 counts up in decrements defined by R_SWITCH_F_INC. When R_SWITCH_F has a data value of "0", Counter 130 counts down in increments defined by R SWITCH_F_DEC. The counting by Counter 130 provides a data value for the parameter R_SWITCH_F_CNTR.

FIG. 2 shows that use of the counting by Counter 130 is determined by the state of a switch function 132 that is itself under the control of Remote Start/Stop Switches Input Section 60. When the value of the output of OR logic function 120 is "0", an inverting function 134 causes switch function 132 to pass the counting of Counter 130 to a hysteresis function 136. When the value of the output of OR logic function 120 is "1", inverting function 134 causes switch function 130 not to pass the counting to function 136 and also resets the count to zero.

The output of OR logic function 120 can also reset a latch function 138 in Section 50. When the value of the output of OR logic function is "1", it forces latch function 138 to a reset state. When the value of the output of OR logic function is "0", it allows latch function 138 to be set to a set state based on the count.

When Section 60 allows latch function 138 to be set, the latter will be set from the reset state to the set state when the count in counter 130 reaches a limit that in the embodiment shown corresponds to the count reaching a predetermined maximum as determined by the capacity of the counter. FIG. 4 shows that capacity to be 65535, the upper limit of a working range that spans values from zero to 65535.

A parameter R_SWITCH_F_FLG indicates the state of latch function 138. One purpose of R_SWITCH_F_FLG is to determine which of switches 14 and 16 is indicated as faulty, and that is accomplished by using R_SWITCH_F_FLG as one input to each of two AND logic functions 140, 142 in Fault Isolation sub-section 50A.

The other input to AND logic function 140 is the parameter R_START_SW_STS from debounce logic function 104B. The other input to AND logic function 142 is the parameter R_STOP_SW_STS from inverting function 106C.

When latch function 138 is in the reset state, it forces the outputs of both AND logic functions 140, 142 to "0". When latch function 138 is in the set state, it enables the output of AND logic function 140 to become a "1" whenever R_START_SW_STS is also a "1", and it enables the output of AND logic function 142 to become a "1" whenever R_STOP_SW_STS is also a "1".

The output of AND logic function 140 represents the parameter R_START_SW_F_FLG, a parameter that, as mentioned earlier, is one of the two inputs to AND logic function 112 in Section 60. The output of AND logic function 142 represents the parameter R_STOP_SW_F_FLG, a parameter that, as mentioned earlier, is one of the two inputs to AND logic function 118 in Section 60. Hysteresis function 136 prevents latch function 138 from being needlessly toggled by perturbations in the count.

In-cab Crank Switch Fault Detection sub-section 70A has certain similarities to the fault detection portion of Section 50. Those similarities comprise an Up-Down Counter 146 that can count up in up-count increments and down in down-count decrements. The data value for the parameter IC_SWITCH_F_INC defines the up-count increment and the data value for the parameter IC_SWITCH_F_DEC defines the down-count decrement. The direction in which counter 146 counts is controlled by a parameter IC_SWITCH_F. When IC_SWITCH_F has a data value of "1", Counter 146 counts up in increments defined by IC_SWITCH_F_INC. When IC_SWITCH_F has a data value of "0", Counter 146 counts down in decrements defined by IC_SWITCH_F_DEC. The counting provided by Counter 130 provides the data value for the parameter IC_SWITCH_F_CNTR.

FIG. 2 shows that use of the count in Counter 146 is controlled by the state of a switch function 148 controlled by the output of an Exclusive OR Logic function 150. When the output of Exclusive OR logic function 150 is "0", an inverting function 152 causes switch function 148 to pass the counting provided in Counter 146 to a hysteresis function 154. When the value of the output of Exclusive OR logic function 150 is "1", inverting function 152 causes switch function 148 not to pass the count to hysteresis function 154 and also resets the count to zero.

The output of Exclusive OR logic function 150 can also reset a latch function 156 in Section 70. When the output of Exclusive OR logic function 150 is "1", it forces latch function 156 to a reset state. When the value of the output of Exclusive OR logic function 150 is "0", it allows latch function 156 to be set to a set state based on the count.

When Exclusive OR logic function 150 allows latch function 156 to be set, the latter will be set from the reset state to the set state when the count in counter 146 reaches a limit that in the embodiment shown corresponds to the count reaching a predetermined maximum as determined by the capacity of counter 146. FIG. 4 shows that capacity to be 65535, the upper limit of a working range that spans values from zero to 65535.

A parameter IC_SWITCH_F_FLG indicates the state of latch function 156 and serves to indicate if ignition switch 12 is faulty.

A store 158 is associated with Exclusive OR logic function 150 in the same way as stores 108, 114 are with Exclusive OR logic functions 110, 116. IC_START_SW_STS is the input to store 158 and Exclusive OR logic function 150 in the same way as R_START_SW_STS and R_STOP_SW_STS are to stores 108, 114 and Exclusive OR logic functions 110, 116.

The output of an OR logic function 160 provides the parameter IC_SWITCH_F. The two inputs to OR logic function 160 are from the respective outputs of two AND logic functions 162, 164. R_TIMER_EN from comparison function 125 is one input to AND logic function 162. The other input to AND logic function 162 is IC_START_SW_STS. RUN_LTCH_FLG and IC_START_SW_STS are the two inputs to AND logic function 162.

From the earlier description of the two-second timing window during which switches 14, 16 were checked for faults, it can be understood that the same two-second window is also used for checking ignition switch 12, and intervening circuitry, for faults.

Section 70 enables ignition switch 12 to crank the truck's engine via a parameter IC_CRANK_EN provided by the output of a switch function 166. The state of switch function 166 is controlled by IC_SWITCH_F_FLG. When IC_SWITCH_F_FLG indicates that latch function 156 is reset, IC_CRANK_EN is determined by the output of an AND logic function 168. When IC_SWITCH_F_FLG indicates that latch function 156 is set, IC_CRANK_EN is forced to "0".

There are four inputs to AND logic function 168. They are: IC_START_SW_STS, the output of an inverting function 170, the output of an inverting function 172, and the output of an OR logic function 174. The output of inverting function 170 is the logic inverse of R_TIMER_EN. The output of inverting function 172 is the logic inverse of CAN_REMOTE_START_EN. The two inputs to OR logic function 174 are CAN_NEUTRAL_SW_EN and DDS_CRANK_STS.

Remote Engine Accel. (Acceleration) Logic section 80 comprises a switch function 180 controlled by an AND logic function 182. There are five inputs to AND logic function 182: RUN_LTCH_FLG, the inverse of R_SWITCH_F_FLG, CAN_REMOTE_START_EN, R_START_SW_STS, and PBA_CRANK_EN. The inverse of R_SWITCH_F_FLG is provided by an inverting function 184. NLIDL is one input to switch function 180. The other is the output of a summing function 186 that processes R_START_N_INC and the output of a store function 188 whose input if the output of switch function 180.

The output of switch function 180 is an input to a limiter function 190 whose output is R_START_N_DES.

Remote Engine Stop Logic section 90 comprises an AND logic function whose output provides R_STOP_FLG. There are four inputs to AND logic function 192: the inverse of R_TIMER_EN provided by an inverting function 192, PBA_CRANK_EN, CAN_REMOTE_START_EN, and the output of an OR logic function 194. There are four inputs to OR logic function 194: the inverse of CCCS_VSS_EN provided by an inverting function 196, R_SWITCH_F_FLG, and the outputs of two AND logic functions 198, 200.

The two inputs to AND logic function 198 are RUN_LTCH_FLG and R_STOP_SW_STS. The two inputs to AND logic function 200 are R_START_SW_STS and R_STOP_SW_STS.

CCCS_VSS_EN is provided by an AND logic function 202 having two inputs. One input is the inverse of VSS_F_ORH provided by an inverting function 204. The other is the output of a comparison function 206 that compares VS with zero.

Crank Enable Logic section 100 provides an output CRANK_ENABLE to ESC 11 for selectively enabling and unenabling the engine to be cranked. For installing the remote start feature in an appropriate truck model, a switch function 210 interfaces the output of an OR logic function 212 with ESC 11. When the appropriate model is programmed via the programmable parameter NGV[PP], switch function 210 allows the output of OR logic function 212 to pass as CRANK_ENABLE to another module or modules of ESC 11 that perform cranking.

There are two inputs to OR logic function 212. One is IC_CRANK_EN. The other is the output of an AND logic function 214. There are four inputs to AND logic function 214: CAN_REMOTE_START_EN, the inverse of R_TIMER_EN provided through an inverting function 216, the inverse of R_SWITCH_F_FLG provided through an inverting function 218, and the output of an AND logic function 220.

There are four inputs to AND logic function 220: R_START_SW_STS, CAN_NEUTRAL_SW_EN, CCCS_VSS_EN, and PBA_CRANK_EN.

CAN_NEUTRAL_SW_EN is provided by the output of an AND logic function 222 that has two inputs. One input is CAN_NEUTRAL_SW. The other is the output of a latch function 224. ESC 11 furnishes a signal Key_On_Reset to a reset input of latch function 224. Latch function 224 can be set by the output of an AND logic function 226 to a set input. One input to AND logic function 226 is CAN_NEUTRAL_SW. The other input is from an inverting function 228 that inverts the content of a store 230 that stores CAN_NEUTRAL SW.

If IC_CRANK EN is a "1" meaning that conditions for allowing the ignition switch 12 to crank the engine have been satisfied, crank enable logic section 100 will cause CRANK_ENABLE to be a "1" so that when ignition switch 12 is operated to CRANK position, ESC 11 will cause the engine to be cranked.

A number of conditions must be satisfied for R_CRANK_EN to cause CRANK_ENABLE to be a "1". Because R_TIMER_EN is a "1" when virtual controller 10 is in the switch diagnostic mode, discontinuance of that diagnostic mode is indicated by the inverse of R_TIMER_EN being a "1", one of the conditions that AND logic function 214 requires to be satisfied. A second condition is that section 50 have detected no fault during the switch diagnostic mode. Satisfaction of that condition is indicated by the inverse of R_SWITCH_F_FLG being "1". A third condition is that the remote start feature be enabled and satisfaction of that condition is indicated by CAN_REMOTE_START_EN being a "1". The fourth condition is a satisfaction of a number of additional conditions, as provided by AND logic function 220.

AND logic function requires that: proper status of remote start switch 14 be indicated by R_START_SW_STS being a "1"; application of the park brake be indicated by PBA_CRANK_EN being a "1"; and that the truck not be moving, indicated by CCCV_VSS_EN being a "1". The fourth condition is that the neutral switch indicate that the transmission in the truck's driveline be neutral and also that the switch has been actuated. The requirement for actuation of the neutral switch is provided by functions 224, 226, 228, and 230 as a way to prevent remote cranking in a situation where service personnel may have shorted the switch by applying a jumper wire around it for their convenience. If the jumper wire is left in place through inadvertence or otherwise, there would be no assurance that the neutral switch is working properly. Requiring indications that the switch indicate neutral and also actual actuation to neutral prove that the switch is functional.

Remote Engine Stop Logic section 90 provides an output R_STOP_FLG to ESC 11. When R_STOP_FLG is a "1", it causes the engine to stop. AND logic function 192 requires a number of conditions to be satisfied for R_STOP_FLG to change from a "0" to a "1". One of the conditions that AND logic function 192 requires to be satisfied is that the remote start feature be enabled; satisfaction of that condition is indicated by CAN_REMOTE_START_EN being a "1". A second condition is discontinuance of that diagnostic mode, indicated by the inverse of R_TIMER_EN being a "1". A third condition is application of the park brake, indicated by PBA_CRANK_EN being a "1". A fourth condition is a satisfaction of any of one or multiple other conditions, as provided by OR logic function 194.

When R_SWITCH_F_FLG is a "1", indicating a remote switch fault, the output of OR logic function is a "1".

When both RUN_LTCH_FLG and R_STOP_SW_STS are "1", the output of OR logic function is a "1".

When both R_START_SW_STS and R_STOP_SW_STS are "1", the output of OR logic function is a "1".

When the inverse of CCCS_VSS_EN is a "1", the output of OR logic function is a "1". The inverse of CCCS_VSS_EN is a "1" when the truck is not moving (i.e. speed is zero as determined by function 206) and there is no speed input fault indicated (inverse of VSS_F_ORH).

Consequently, OR logic function 194 provides that: 1) if a fault is detected in either remote switch via change in R_SWITCH _F_FLG, but only while in key-on state, the engine is automatically shut down; 2) if the remote start feature is unenabled by ESC 11, the engine is not allowed to be cranked; and 3) if the park brake is released, the engine is not allowed to shut down.

With RUN_LTCH_FLG indicting engine running, actuation of remote stop switch 16 is effective through AND logic function 198 to stop the engine. Also if remote start switch 14 is turned on while remote stop switch 16 is on, AND logic function 200 will be effective to stop the engine.

Stopping the engine via section 90 acts to stop the engine via fuel limiter 27 by shutting off fuel to the engine. The engine can still be cranked without fueling to enable compression testing without actually running the engine.

When RUN_LTCH_FLG ceases to indicate engine running, the engine must stop before it can re-started.

Remote Engine Accel. (Acceleration) Logic section 80 allows the engine, once started, to be accelerated and decelerated. Any speed input to limiter function 190 that exceeds a maximum limit set by function 190 will run the engine only at the maximum limit allowed by function 190. Below that, the engine will run at the speed input to the limiter function.

With switch function 180 off, NLIDLE causes the engine to run at low idle. Switch function 180 is turned on by AND logic function 182, provided that the input conditions are satisfied. With switch function on, the engine is accelerated by incrementing store 188 in increments of speed defined by R_START_N_INC, one of the calibration parameters shown in FIG. 4. Incrementing occurs at defined intervals of time. Although the illustrated embodiment uses only positive increments that accelerate the engine, decelerations could also be incorporated.

The use of a normally closed remote stop switch in conjunction with the remote switch fault detection strategy enables continuity from the remote stop switch to the ESC to be verified. This capability would enable a broken wire or bad connection to be detected.

Once any sort of a fault has been indicated, the engine cannot be restarted until the source of the fault has been found, and the fault corrected. The fault detection strategy gives the ability to identify the faulty functions.

PBA_CRANK_EN is provided by Park Brake Signal Processing 21 in a similar manner to that involving the transmission neutral switch in that PBA_CRANK_EN requires both that the park brake is being applied and that it has been operated from non-applied to applied, thereby verifying functionality of the park brake switch.

The strategy shown in FIGS. 5, 6, 7, 8, 9, and 10 is generally similar to that of FIGS. 1-3, but with some differences that will be discussed. One significant difference is that remote stop switch 16 is normally open, instead of normally closed. Each switch 14, 16 is spring-biased open and has a pushbutton actuator that must be depressed against the spring-bias to close the switch.

Figure 5:
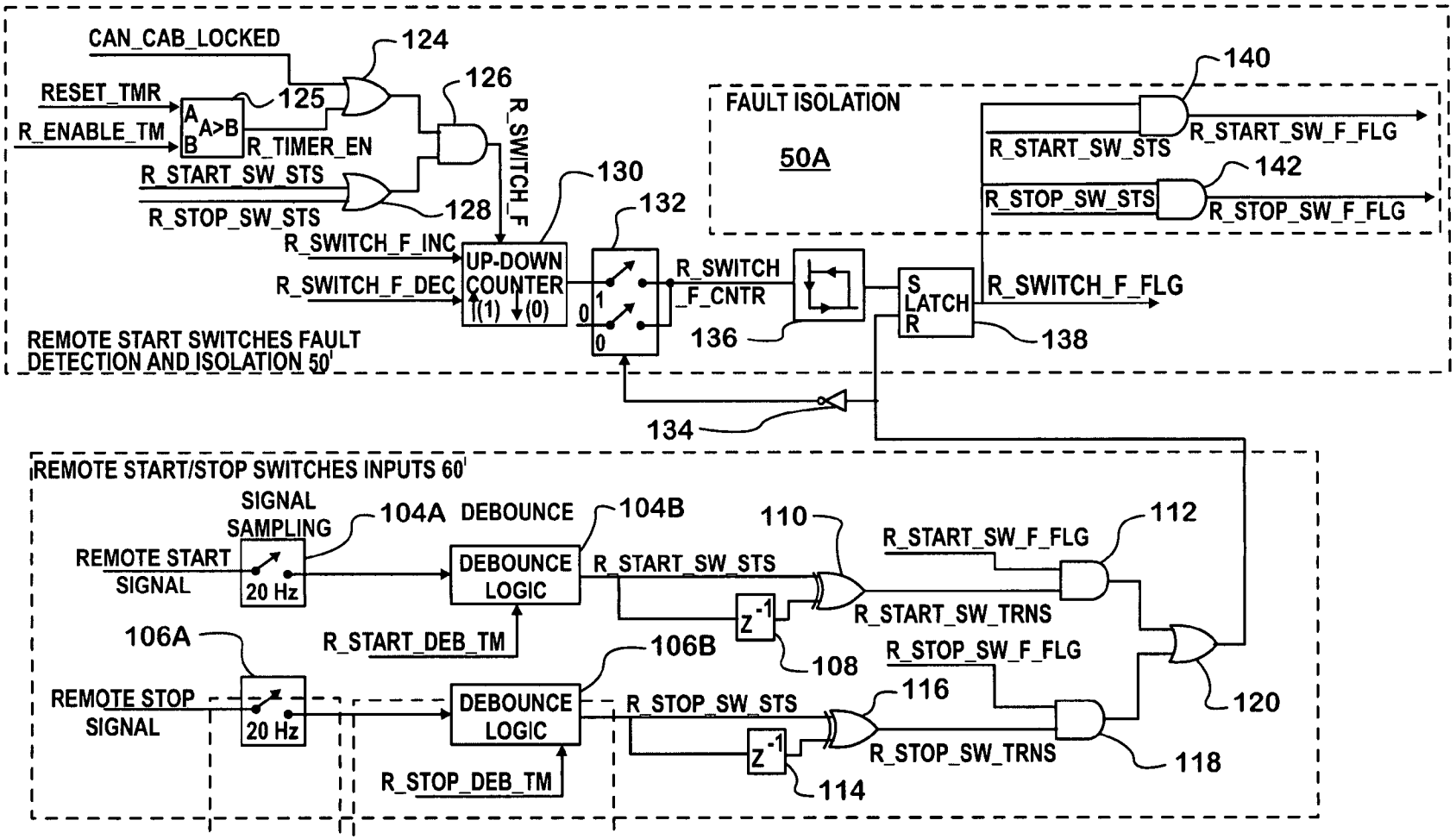
FIGS. 5, 6, 7, 8, 9, and 10 are portions of a software strategy diagram comprising another embodiment.

Remote Start/Stop Switches Inputs section 60' of FIG. 5 corresponds to Remote Start/Stop Switches Inputs section 60 of FIG. 2 with the exception that the variable CAN_CAB_LOCKED replaces CAN_REMOTE_START_EN and inverting function 122, and no inverting function 106C is required to invert the output of debounce logic 106B because the remote stop switch is now normally open, instead of normally closed. CAN_CAB_LOCKED is a switch signal from a switch that distinguishes between the cab being locked to the chassis and being unlocked from the chassis. Otherwise those sections 60, 60' are identical with like reference numerals serving to designate like elements.

Figure 6:
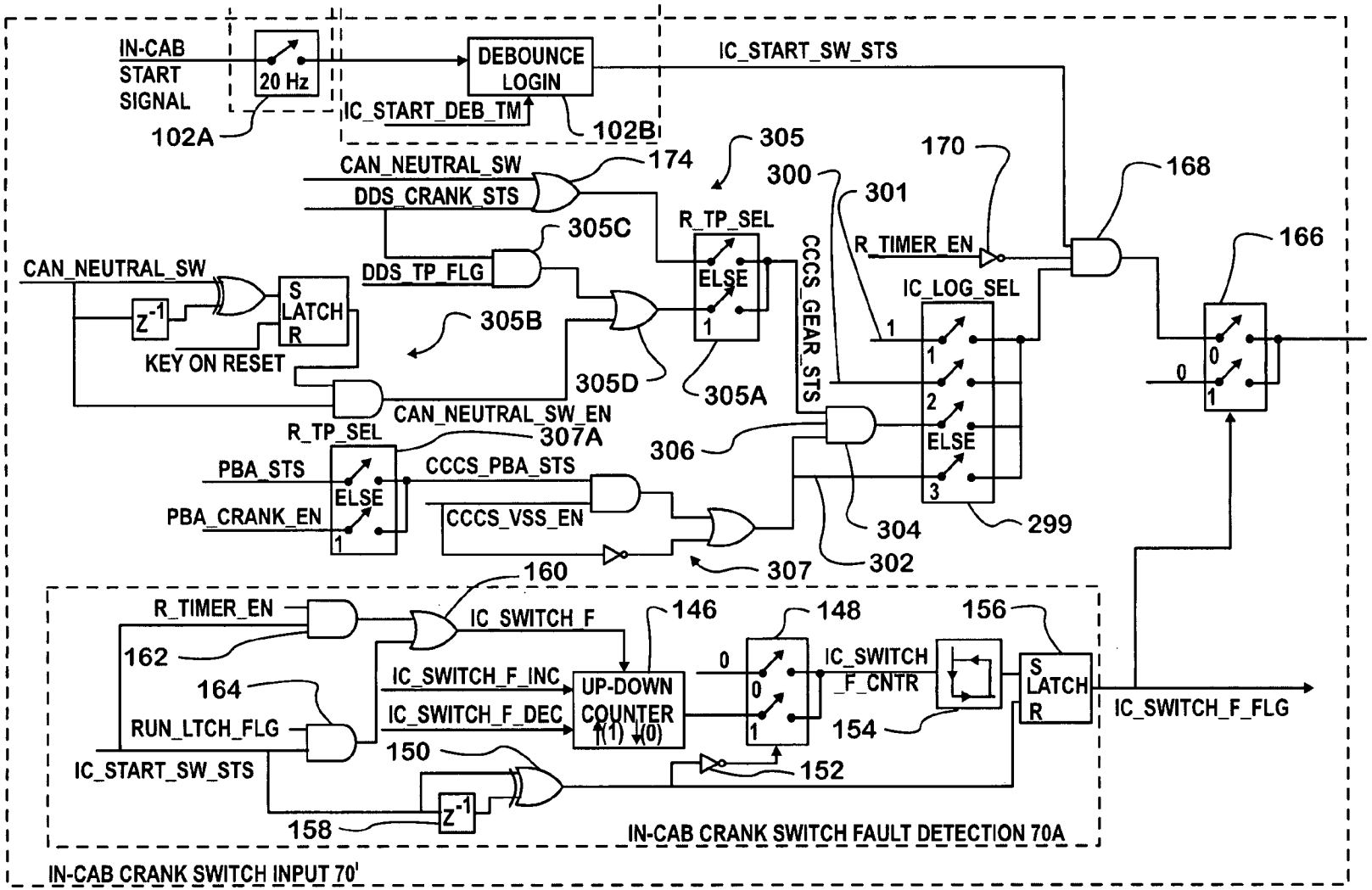

In-cab Crank Switch Input section 70' of FIG. 6 corresponds to In-cab Crank Switch Input section 70 of FIG. 2. They are basically the same except for the specific conditions that enable AND logic function 168. Like reference numerals in those two Figures designate like elements.

Figure 7:
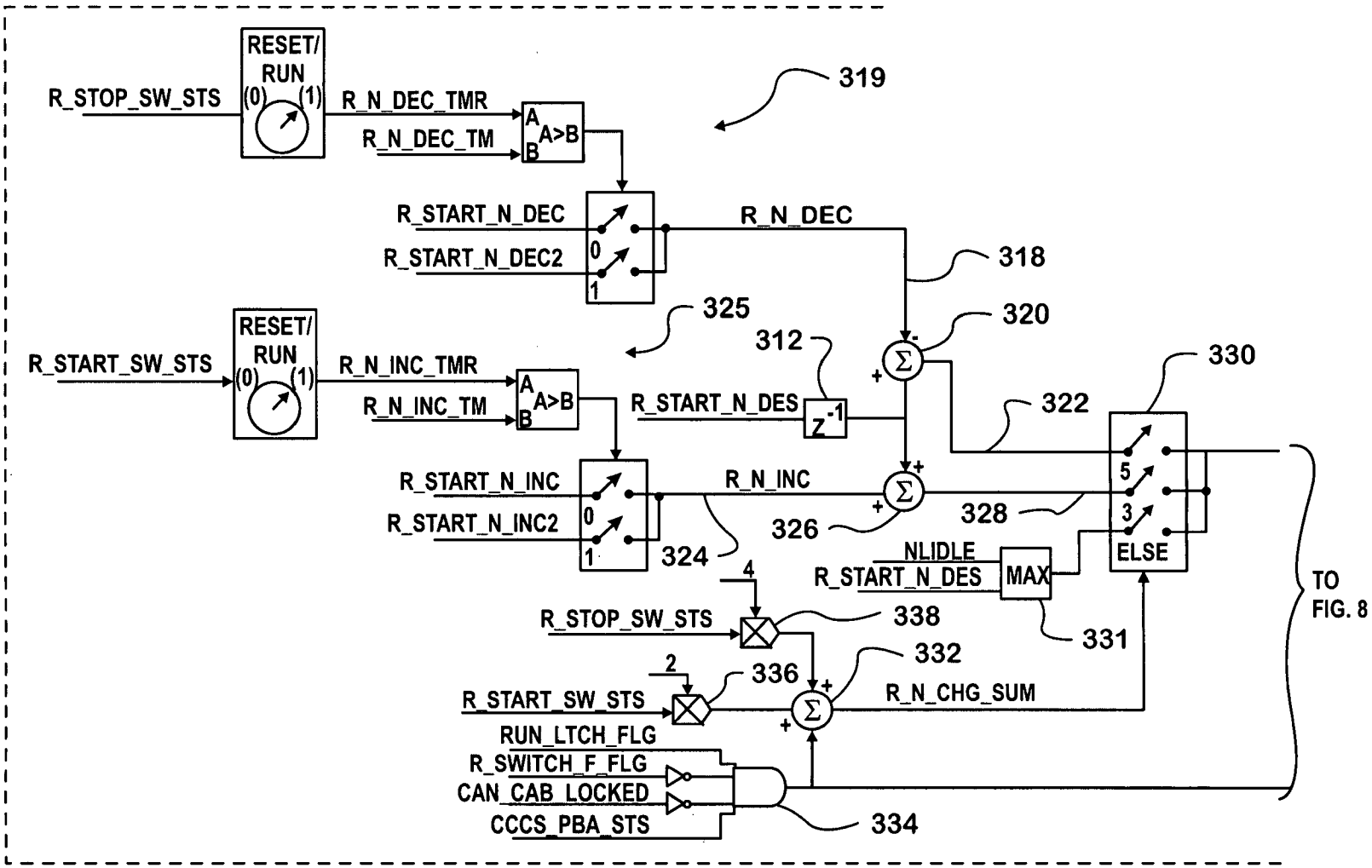
Figure 8:
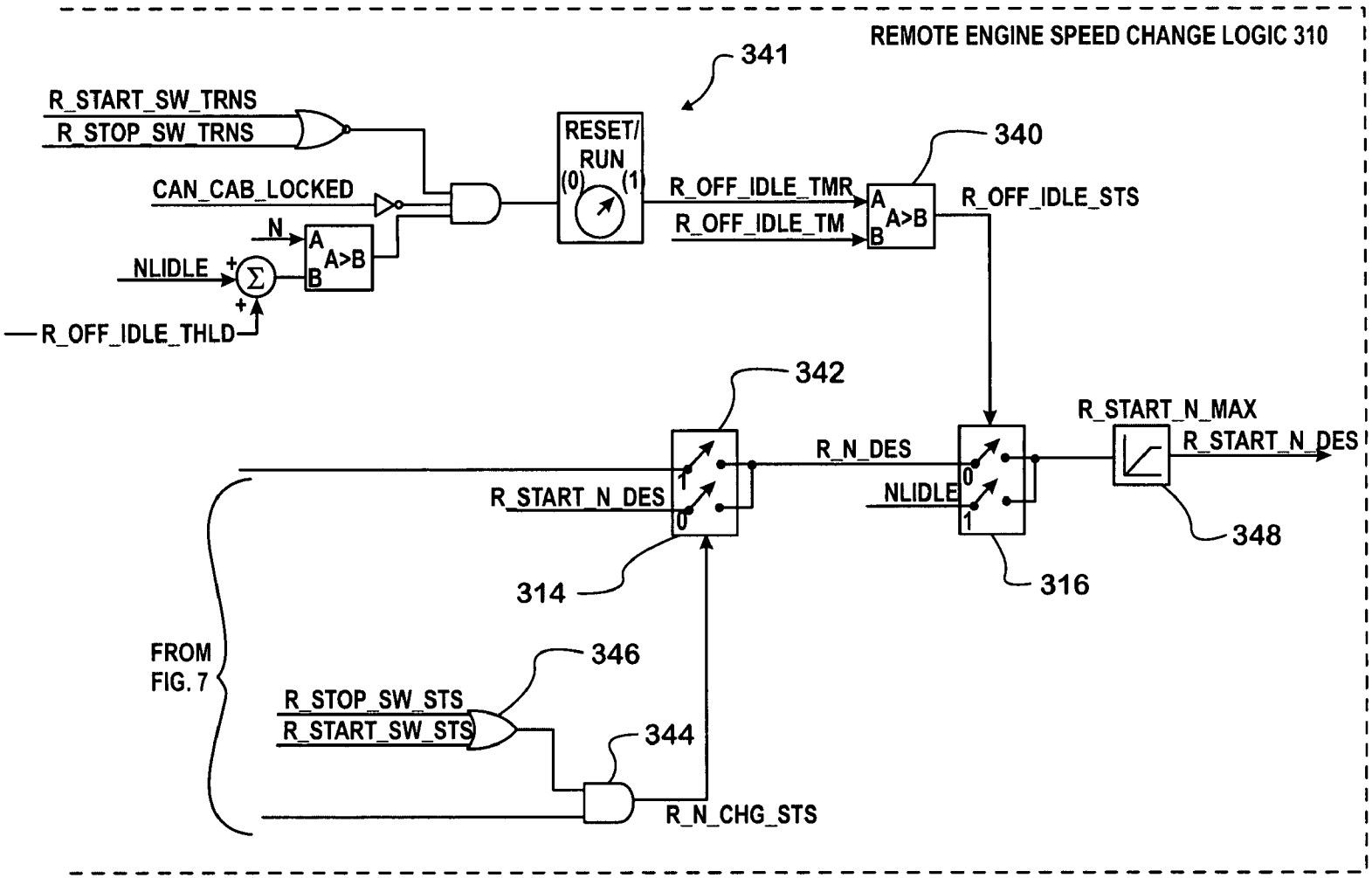

A more extensive difference between the two embodiments is that a Remote Engine Speed Change Logic Section 310, shown in FIGS. 7 and 8, replaces Remote Engine Acceleration Logic Section 80 of FIG. 3. Also, a rather different Remote Engine Stop Logic section 349, shown in FIG. 9, replaces Remote Engine Stop Logic Section 90, and a Remote Test No Fueling Logic Section 358, also shown in FIG. 9, has no specific corresponding section in either FIG. 2 or 3. Crank Enable Logic section 100' of FIG. 10 corresponds to Crank Enable Logic section 100 of FIG. 3, but with some differences.

In-cab Crank Switch Input Section 70' in FIG. 6 comprises a software switch 299 that in conjunction with debounce logic 102B and the output of inverting function 170 provides several possibilities for enabling AND logic function 168. Three of four possible selections are identified by the numerals 300, 302, 304 as inputs to switch 299. A fourth possible selection 301 is a logic value "1".

Selection 300 is the variable CCCS_GEAR_STS that is developed by a logic section 305 that includes function 174 from the first embodiment. Selection 302 is developed by a logic section 307 from variables PBA_STS and PBA_CRANK_EN, and CCCS_VSS_EN. Selection 304 is provided by an AND logic function 306 to which selections 300 and 302 are inputs.

Figure 10:
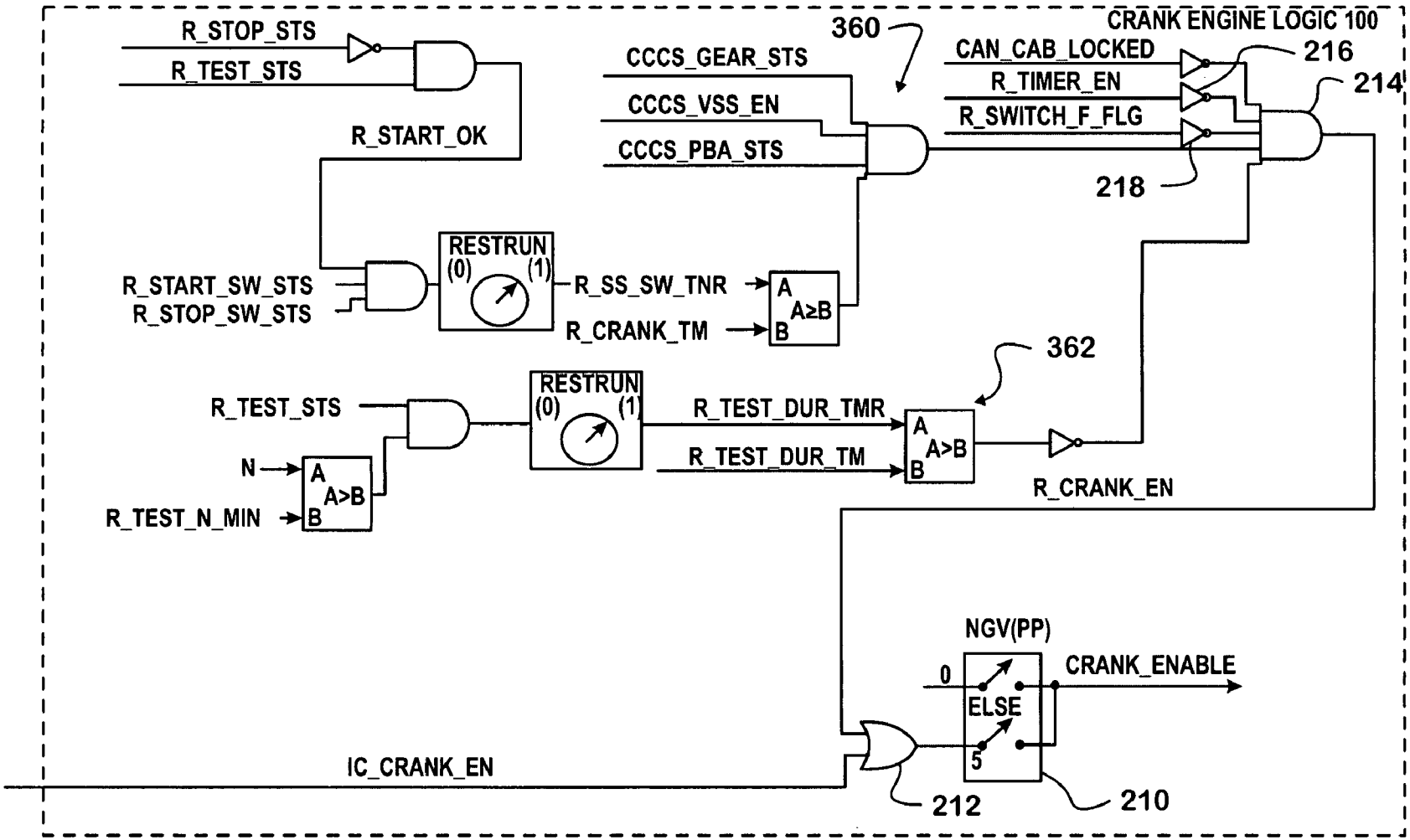

Switch 166 still provides IC_CRANK_EN to function 212 in FIG. 10 based on the state of AND function 168 as long as no in-cab crank switch fault is detected; however, switch 299 allows the conditions that enable AND function 168 to be set by programming switch 299 to make a particular one of the four possible selections 300, 302, 304, 301 which are respectively, 1) driveline disengaged, 2) park brake applied, 3) both driveline disengaged and park brake switch applied, and 4) a selection that, by providing a logic "1" to AND function 168, makes enablement of that function independent of driveline and park brake status.

Logic section 305 comprises a switch function 305A that is used to offer two levels of enablement of CCCS_GEAR_STS. A lower level is provided by OR logic function 174, while a higher level is provided by an OR logic function 305D. OR logic function 174, when selected by switch function 305A, causes CCCS_GEAR_STS to be a logic "1" when either the driveline is disengaged or the neutral start switch shows the transmission in neutral.

An AND logic function 305C is one input to OR logic function 305D. The other input is from a logic section 305B. When switch function 305A is selecting the higher level of enablement, CCCS_GEAR_STS will be a logic "1" either when the driveline is disengaged and a driveline "tamper-proofed" flag has also been set, or when the neutral switch is disclosing neutral and the neutral switch has been operated to show neutral after the ignition switch has been turned to ON position.

In the crank enable logic 100' of FIG. 10, the inverse of variable CAN_CAB_LOCKED and two logic strategies 360, 362 are inputs to AND logic function 214. Switch function 210, OR logic function 212, AND logic function 214, and inverting functions 216 and 218 have the same relationship as in section 100 of FIG. 3.

As an aid to understanding more detailed description that will be given later, it may be helpful to briefly explain how the remote start and remote stop switches control the engine.

When the engine is not running, depressing either remote switch, but not both, will not cause the engine to crank and start. Cranking is enabled by logic sections 360, 362 and functions 214, 212 in FIG. 10. Logic section 360 serves to cause both cranking and fueling for starting the engine. Logic section 362 serves to cause cranking without fueling.

If both remote switches 14, 16 are concurrently held depressed for more than an amount of time set by R_CRANK_TM in logic section 360, and the other conditions associated with that logic section are satisfied, the engine will crank and begin to run.

Figure 9:
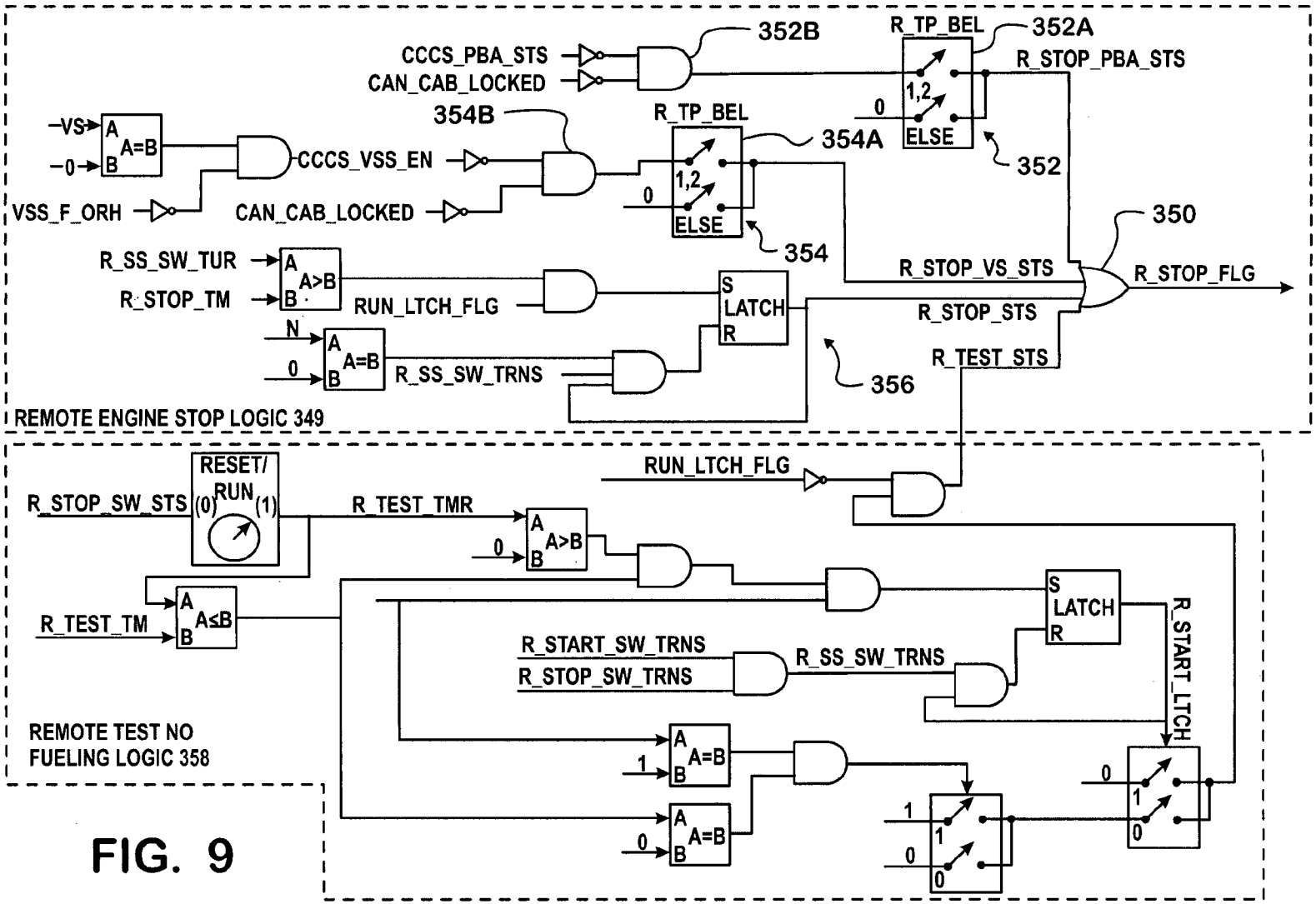

Remote Test No Fueling Logic Section 358 of FIG. 9 shows the strategy for cranking without fueling. Briefly, the strategy is executed by depressing the remote stop switch and holding it depressed while the remote start switch is then depressed and held depressed for an amount of time set by R_TEST_TM. to cause the value of R_TEST_STS to switch from a logic "0" to a logic "1". This causes logic section 362 of Crank Enable Logic 100' to crank the engine for an amount of time determined by R_TEST_DUR_TM. It also acts via logic function 350 of Remote Engine Stop Logic Section 349 to prevent engine fueling.

Remote Engine Speed Change Logic Section 310 (FIGS. 7 and 8) controls engine speed by setting the data value for R_START_N_DES and also stopping.

Once the engine has been cranked and started, it will run at low idle speed set by the data value of NLIDLE. The remote switches no longer need to be held depressed and therefore are typically released.

If both switches are thereafter held concurrently depressed for more than an amount of time set by R_STOP_TM (FIG. 9), then logic section 356 of Remote Stop Logic Section 349 acts via function 350 to stop the engine. The logic prevents the engine from being re-started until reset.

Each logic section 352, 354 of Remote Stop Logic Section 349 will stop the engine by itself certain events occur. Section 352 comprises a switch function 352A that, like switch function 305A in FIG. 6, is used to select a higher or a lower level of enablement. The lower level of enablement renders CAN_CAB_LOCKED and CCCS_PBA_STS of no effect on R_STOP_PBA_STS. The higher level renders them effective by causing R_STOP_PBA_STS to stop the engine when either the applied park brake is released or the cab is unlocked from the chassis.

Section 354 comprises a switch function 354A that, like switch function 352A, is used to select a higher or a lower level of enablement. The lower level of enablement renders CAN_CAB_LOCKED and CCCS_VSS_EN of no effect on R_STOP_VS_STS. The higher level renders them effective by causing R_STOP_VS_STS to stop the engine when either the cab is unlocked from the chassis or the vehicle is in motion.

Logic section 325 (FIG. 7) functions, with the engine running, to accelerate the engine when the remote start switch is depressed without the remote stop switch also being depressed. Speed change is accomplished by a summing function 326 incrementing the current value of R_START_N_DES as obtained from a store 312 by an increment R_N_INC, provided at 324. This yields the sum provided at 328 to a switch function 330.

The state of switch function 330 is controlled by the value of R_N_CHANGE_SUM, as provided by a summing function 332. An AND logic function 334 provides a value of "1" to summing function 332 provided that the conditions that enable the AND logic function are satisfied. With the remote start switch being depressed, a function 336 provides a value of "2" to the summing function. As long as the remote stop switch is not being depressed, the value for R_N_CHANGE_SUM will be "3" causing the sum from function 326 to be passed by switch function 330.

As long as conditions are appropriate for increasing engine speed, as monitored by functions 346 and 334 (FIG. 8) as inputs to a function 344, R_N_CHG_STS allows a switch function 342 to pass the value from switch function 330 to a switch function 316. As long as the engine speed N does not exceed low idle speed NLIDLE by more than some threshold amount R_OFF_IDLE THLD, as determined by a logic section 341 for a time determined by a function 340, then switch function 316 passes the value from switch function 342 for use as the value for R_START_N_DES, subject to limiting by function 348 when the value exceeds a predetermined maximum. Otherwise the value for NLIDLE is used.

At each iteration of the strategy, the value of R_START_N_DES provided by function 348 updates the corresponding input to switch function 342 and the data value in store 312.

Holding remote start switch depressed is effective to repeatedly increment R_START_N_DES, causing the engine to accelerate until the switch is released. The engine will remain running at the speed to which it has been accelerated.

Intermittently depressing and releasing the remote start switch will cause the engine to accelerate in increments.

Depressing the remote stop switch, while the remote start switch is not being depressed, is effective to decelerate the engine.

With the state of switch function 330 being controlled by the value of R_N_CHANGE_SUM, depressing the remote stop switch now causes a function 338 to provide a value of "4" to summing function 332. Provided that the conditions that enable AND logic function 334 continue to be satisfied, function 332 now provides a value of "5" for R_N_CHANGE_SUM. This switches function 330 to select the sum from a summing function 320, provided at 322, for passing on to switch function 342 (FIG. 8).

Logic section 319 (FIG. 7) functions, with the engine running, to decelerate the engine in an analogous manner to logic section 325 accelerating the engine. Speed reduction is accomplished by summing function 320 decrementing the current value of R_START_N_DES as obtained from store 312 by a decrement R_N_DEC, provided at 318. This yields the sum provided at 322.

Continuously holding the remote stop switch depressed will cause the engine to decelerate until the switch is released. If the engine reaches low idle speed it will remain running at low idle speed. Intermittently depressing and releasing the remote stop switch will cause the engine to decelerate incrementally depending on how frequently the switch is depressed and released. If neither remote switch is being depressed after the engine has been started, R_N_CHG_SUM will have a value other than either "3" or "5", in which circumstance a function 331 provides a data value (the larger of NLIDLE and R_START_N_DES) for passing on by switch function 330 to switch function 342.Description of the variables, programmable parameters, and calibration scalars used in FIGS. 5-10 is presented in FIGS. 11-12.

The presence of selectable switch functions like 305A, 307A, 352A, and 354A provides the owner/operator a vehicle with various options for selectively enabling remote control of the engine. Typically these selections are made at the time the vehicle is new, but they may be made by re-programming of the portion of the engine control strategy involving remote control of engine operation.

The embodiment shown in FIGS. 2 and 3 requires both that the ignition switch be ON and that the cab be unlocked from the vehicle chassis to enable remote control of the engine by switches 14, 16. With the remote control enabled by those two conditions, the ignition switch is prevented from cranking the engine. When the remote control is not enabled, the ignition switch is able to crank the engine.

The embodiment shown in FIGS. 6-10 is like that of FIGS. 2 and 3 except that when the remote control is enabled by the ignition switch being on and the cab unlocked from the chassis, the engine can still be cranked by the ignition switch, although the act of unlocking the cab from the chassis is usually done with the intent that the cab will be swung open to a position that not only allows engine access, but that also makes it difficult for a person to enter the cab.

While a presently preferred embodiment of the invention has been illustrated and described, it should be appreciated that principles of the invention apply to all embodiments falling within the scope of the following claims.

What is claimed is:

1. A control input selection system for controlling an engine in a motor vehicle through the selective use of two sets of control inputs to an engine control system, one set comprising occupant compartment controls inside an occupant compartment and the other set comprising remote controls outside the occupant compartment, the selection system comprising:

a selection input to the engine control system for selecting one of the two sets; and a processor in the engine control system for processing the selection from the selection input and enabling the engine control system, once the engine has been started and is running, to control certain functions related to running of the engine from the set selected by the selection input to the exclusion of the other set.

2. A control input selection system as set forth in claim 1 wherein the selection input comprises a selectively operable device that is associated with a vehicle component that is selectively positionable on the vehicle to allow and disallow access to the engine for servicing the engine, the selectively operable device having association with the vehicle component to signal a status of the vehicle component.

3. A control input selection system as set forth in claim 2 wherein the vehicle component that is selectively positionable on the vehicle to allow and disallow access to the engine for servicing the engine comprises a cab containing the occupant compartment.

4. A control input selection system as set forth in claim 3 wherein the selectively operable device comprises a switch for signaling locked/unlocked status of the cab on the vehicle.

5. A control input selection system as set forth in claim 2 wherein the one set of controls comprises an ignition switch that, when the one set is selected, is selectively operable to crank the engine for starting the engine.

6. A control input selection system as set forth in claim 5 wherein the other set of controls comprises plural switches selectively operable, when the other set is selected, to change engine running speed after starting, and to shut off the engine after running.

7. A control input selection system as set forth in claim 6 wherein the other set, when selected, and with the engine not running, can also be operated to cause the engine control system to crank the engine without fueling for an engine compression test.

8. A control input selection system as set forth in claim 5 wherein the ignition switch is selectively positionable from an OFF position to an ON position to enable the engine to be cranked at starting by further operation to a CRANK position, and to continue running after return to ON position after the engine has started running, and when operated from OFF to ON without further operation to CRANK position, enables the selection input to be effective on the engine control system.

9. A control input selection system as set forth in claim 1 wherein the processor comprises a strategy for conditioning enablement of the set selected by the selection input on the status of one or more devices in the vehicle.

10. A control input selection system as set forth in claim 9 wherein the one or more other devices include a park brake, a driveline, and a transmission.

11. A control input selection system as set forth in claim 9 wherein the processor comprises a strategy for further conditioning enablement of the set selected by the selection input on change in the status of the one or more devices in the vehicle occurring after an ignition switch in the occupant compartment set has been operated from OFF position to ON position.

12. A control input selection system as set forth in claim 1 wherein the other set of controls, when selected, is also selectively operable, with the engine not running, to crank the engine without fueling for an engine compression test.

13. A control input selection system as set forth in claim 1 wherein the one set of controls comprises an ignition switch that, when either set is selected, is selectively operable to crank the engine for starting the engine.

14. A control input selection system as set forth in claim 13 wherein the selection input comprises a selectively operable device that is associated with a vehicle component that is selectively positionable on the vehicle to allow and disallow access to the engine for servicing the engine, the selectively operable device having association with the vehicle component to signal status of the vehicle component.

15. A control input selection system as set forth in claim 14 wherein the other set of controls comprises plural switches selectively operable, when the other set is selected, to change engine running speed after starting, and to shut off the engine after running.

16. A control input selection system as set forth in claim 1 wherein the one set of controls comprises an ignition switch, and the other set of controls, when selected, is also selectively operable, with the engine not running, to crank the engine for starting provided that the ignition switch is in ON position.

17. A method for enabling a running engine in a motor vehicle to be operated by controls that are remote from occupant compartment controls that include an ignition switch, the method comprising:

selecting one of the two controls via a selection input to a processor of an engine control system;

and processing the selection from the selection input to select one of the controls to control continued running of the engine to the exclusion of the other.

18. A method as set forth in claim 17 including selecting the controls that are remote from the engine compartment and using those selected controls to control engine speed and to shut off the engine.

* * * * *